US005259326A

United States Patent [19]

Borgman et al.

[11] Patent Number: 5,259,326

[45] Date of Patent: Nov. 9, 1993

[54] AUTOMATED HEIGHT ADJUSTABLE WORK STATION

[75] Inventors: Randall W. Borgman; William L. Cleair, both of Holland; Thomas J. Osterman; Paul M. Pierce, both of Grand Haven; Brian D. T. Alexander, Fennville; Daniel L. Flower, Kentwood; Greg R. Pattok, Spring Lake; Raymond D. Rosendahl; Donald W. Graham, both of Holland, all of Mich.

[73] Assignee: Haworth, Inc., Holland, Mich.

[21] Appl. No.: 686,660

[22] Filed: Apr. 17, 1991

[51] Int. Cl.[5] ..... A47B 9/00

[52] U.S. Cl. ..... 108/147; 108/20

[58] Field of Search ..... 108/147, 50, 20, 21, 108/22

[56] References Cited

U.S. PATENT DOCUMENTS 4,174,025 12/1987 Wallin et al. ..... 108/147 X
4,440,096 4/1984 Rice et al. ..... 108/147 X
4,656,951 4/1987 Kimura et al. ..... 108/20
4,885,998 12/1909 Span et al. ..... 108/22 X
4,939,333 7/1990 Sakai, Haruo et al. ..... 108/20 X

OTHER PUBLICATIONS

Title Page and P. 5 from Human Factor Technologies, Inc. brochure entitled "People Environment Productivity Workstation Furniture", Sep. 1, 1988.

*Primary Examiner*—Jose V. Chen
*Attorney, Agent, or Firm*—Flynn, thiel, Boutell & Tanis

[57] ABSTRACT

A work station, particularly for supporting a computer, having separate front and back tops having separate powered drive arrangements for permitting independently height adjustment. The drive arrangement includes a separate drive motor associated with each top, with the motors being controlled by a controller, such as a microprocessor. The controller is preferably controlled by an operator using a portable keypad control which can be positioned on one of the tops. The controller can be programmed by the operator to permit storage of a number of predetermined height locations each defining distinct heights for both tops.

16 Claims, 9 Drawing Sheets

AUTOMATED HEIGHT ADJUSTABLE WORK STATION

FIELD OF THE INVENTION

This invention relates to a height-adjustable table or work station and, in particular, to an improved automated table work station having independently height-adjustable front and rear tops which can respectively support the keyboard and screen of a computer, and the method of use thereof.

BACKGROUND OF THE INVENTION

Numerous commercially available tables have been developed specifically for use in supporting small computers, including tables which employ separate height-adjustable front and rear table tops for supporting different parts of the computer, such as the keyboard on the front table top and the screen or monitor on the rear table top. These known tables conventionally employ a mechanical structure which permits each of the front and rear table tops to be manually height-adjusted. Such mechanical structure typically involves releasable height-adjusting stops or manually-actuated gear mechanisms employing drive transmitting rods (such as a flexible shaft) for transmitting torque to mechanisms located adjacent opposite ends of the table. Other known tables employ powered drivers, such as electric motors, but generally a single motor is provided for each height-adjustable table top, with the motor being joined to adjusting mechanism disposed adjacent opposite ends of the table through a drive transmitting shaft (conventionally a flexible shaft) which extends transversely throughout the length of the table. While these known arrangements hence have provided the ability to independently adjust the height of the table, including adjusting the heights of the front and rear table tops independently of one another, nevertheless the known height-adjusting mechanism have traditionally been rather complex mechanical structures which have made adjusting the height more difficult than desired. It has also been observed that while such height adjustment may be performed during the initial set-up of the table and of the computer thereon, nevertheless the table is seldomly adjusted thereafter, since such tables are not readily suitable for encouraging rapid and frequent adjustment in the table top heights so as to either accommodate different operators or to encourage the operator to frequently adopt different working positions.

Accordingly, it is an object of the present invention to provide an improved table or work station, particularly for supporting a computer, with greatly improved height-adjusting capabilities so as to overcome the disadvantages associated with known tables of this general type.

More specifically, the improved table of this invention preferably includes separate and independently height-adjustable front and back table tops each having separate powered drive arrangements for permitting fast and efficient height adjustment of either table top independently of the other. The drive arrangement preferably includes a separate drive motor means associated with each top, with the motor means of the two tops being connected to and controlled by a common controller, such as a microprocessor. The controller in turn is preferably controlled by an operator using a small and portable pendant-type keypad control which can be selectively positioned as desired, such as on one of the tops.

In the improved table of the present invention, as aforesaid, the controller can preferably be programmed by the operator through the control to permit storage of a number of predetermined table height locations, with each such location involving a predetermined and distinct height for each of the front and rear table tops. The controller also preferably permits a plurality of table events to be programmed as a sequence, with each event being defined by one of the predetermined table height locations in conjunction with a predetermined time interval during which the table tops will be maintained at the predetermined height location. The controller and the programming therefor permits the table tops to be automatically sequenced from one table event to the next event so as to facilitate and yet substantially mandate desired changes in table height position. The change from one event to the next event is announced to the operator by visual and/or audible prompts, and movement to the next table event occurs only when the operator inputs an activating signal.

The improved table of the present invention, as aforesaid, preferably includes means associated with the motor and the controller, for providing a visual readout as to the actual height of each table top so as to facilitate proper positioning of the tops at desired heights and/or relocating of the tops at other heights. The controller is capable of determining the existing table height and of driving the tables to new table heights, such as in response to an instruction to move to a predetermined table location as previously programmed into the controller.

The improved table of the present invention, as aforesaid, preferably incorporates a pair of drive motors associated with each table top, namely right and left drive motors associated with the respective right and left support legs or pedestals of the table top. The pair of drive motors are preferably small low-voltage DC motors to eliminate complex electrical and/or mechanical connections between the right and left pedestals. The controller includes means for synchronizing the driving of the two motors so as to maintain the table top substantially level at all times. Each motor of the pair preferably has a brake and signal generating arrangement associated therewith, both coupled to and controlled from the controller. The brake prevents accidental or load-induced downward driving of the table top, and the signal generator sends signals to a counter which is part of the controller to permit storing, programming, and recalling of predetermined table height locations.

Other objects and purposes of the invention will be apparent upon reading the following specification and inspecting the accompanying drawings.

Figure 1:
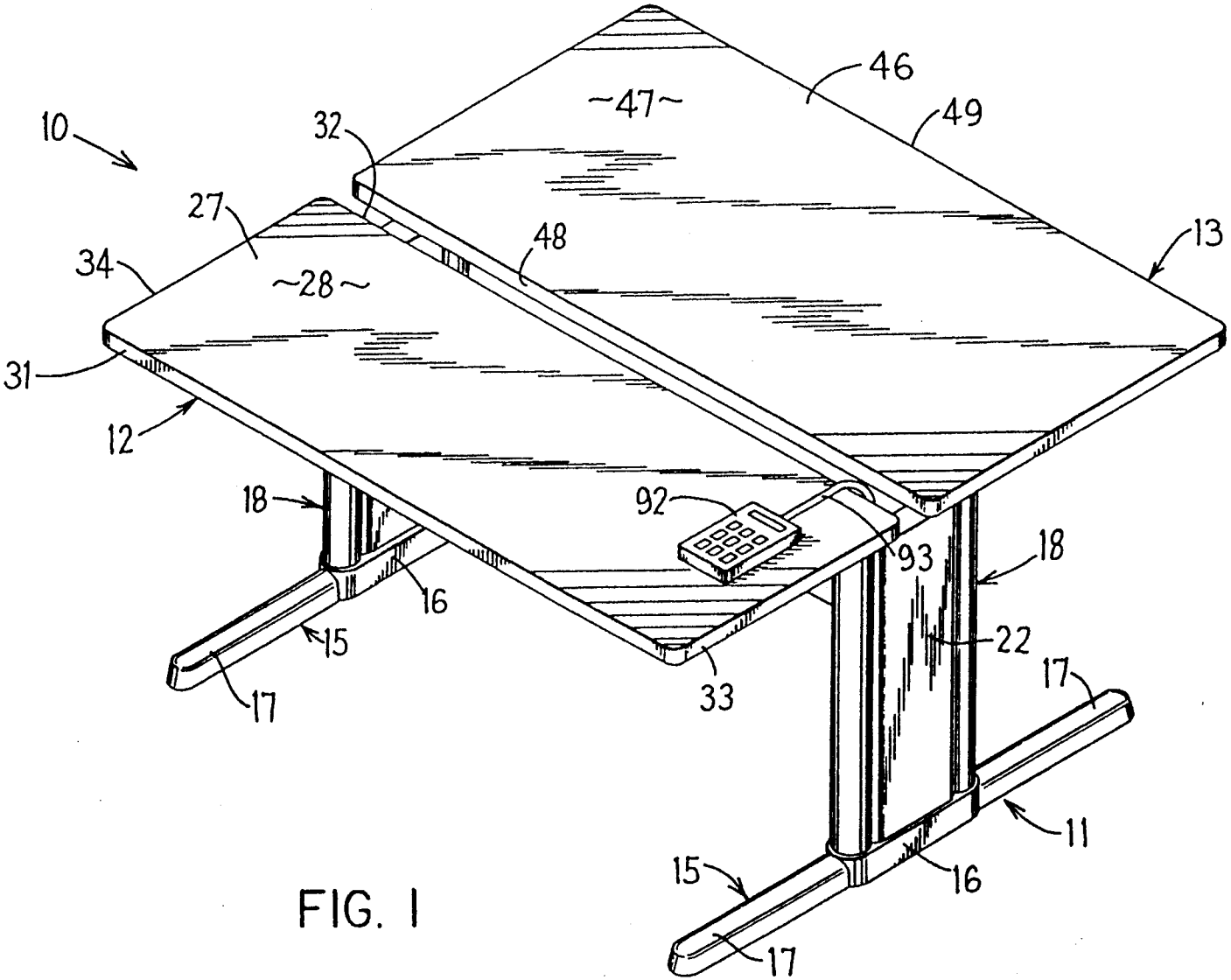
FIG. 1 is a perspective view of the improved table arrangement according to the present invention.

Certain terminology will be used in the following description for convenience in reference only, and will not be limiting. For example, the words "upwardly", "downwardly", "rightwardly" and "leftwardly" will refer to directions in the drawings to which reference is made, and will also refer to the same directions as perceived by a keyboard operator who is standing or sitting in front of the table arrangement. The words "front" and "rear" will be used to denote the portions of the table arrangement which are respectively closest to and furthest away from the operator, with the front and back sides of the table arrangement being respectively positioned more closely adjacent the respective left and right sides in both of FIGS. 1 and 3. The words "inwardly" and "outwardly" will refer to directions toward and away from, respectively, the geometric center of the table arrangement and designated parts thereof. Said terminology will include the words specifically mentioned, derivatives thereof, and words of similar import.

DETAILED DESCRIPTION

Figure 2:
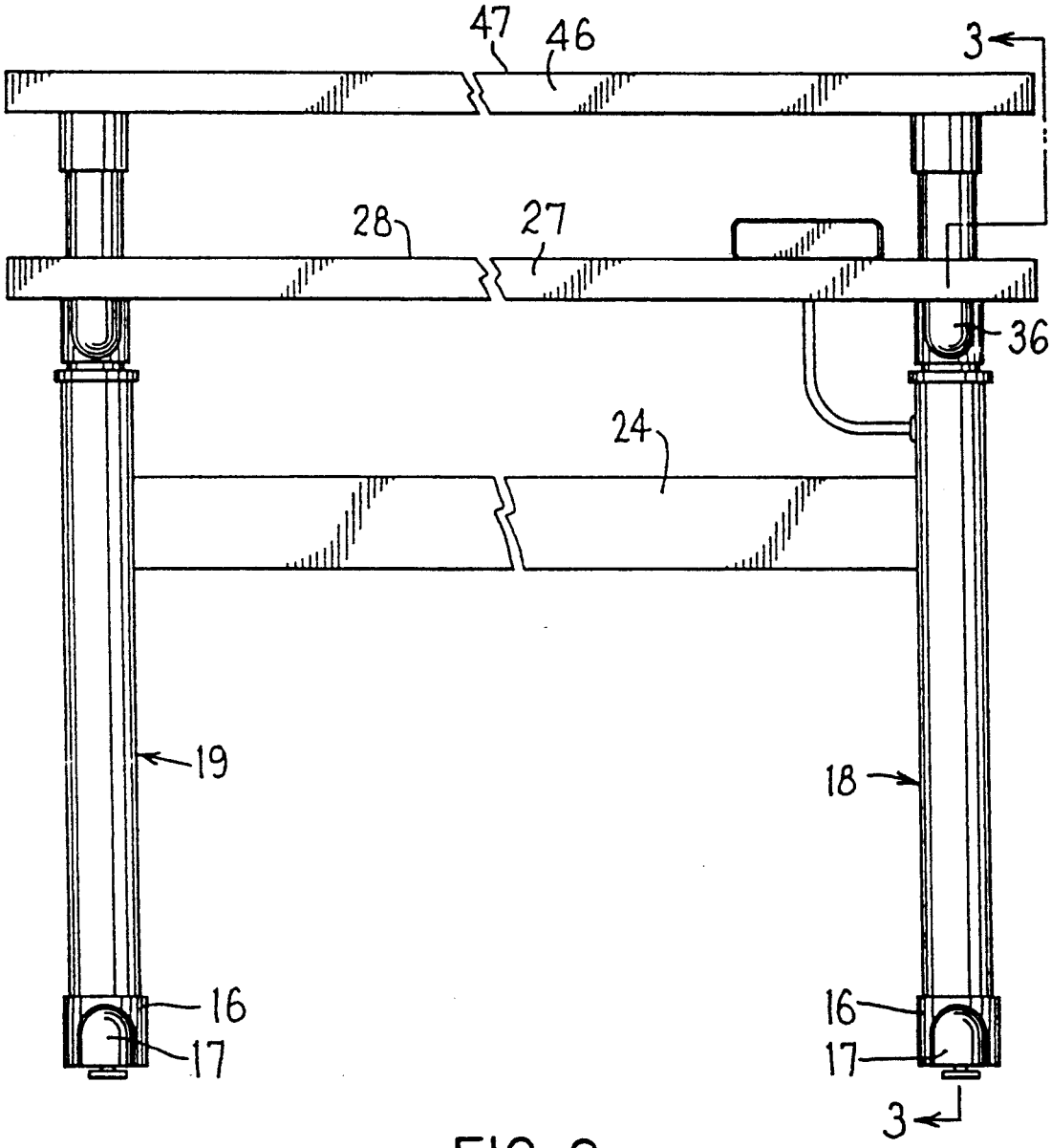
FIG. 2 is a front elevational view thereof.
Figure 3:
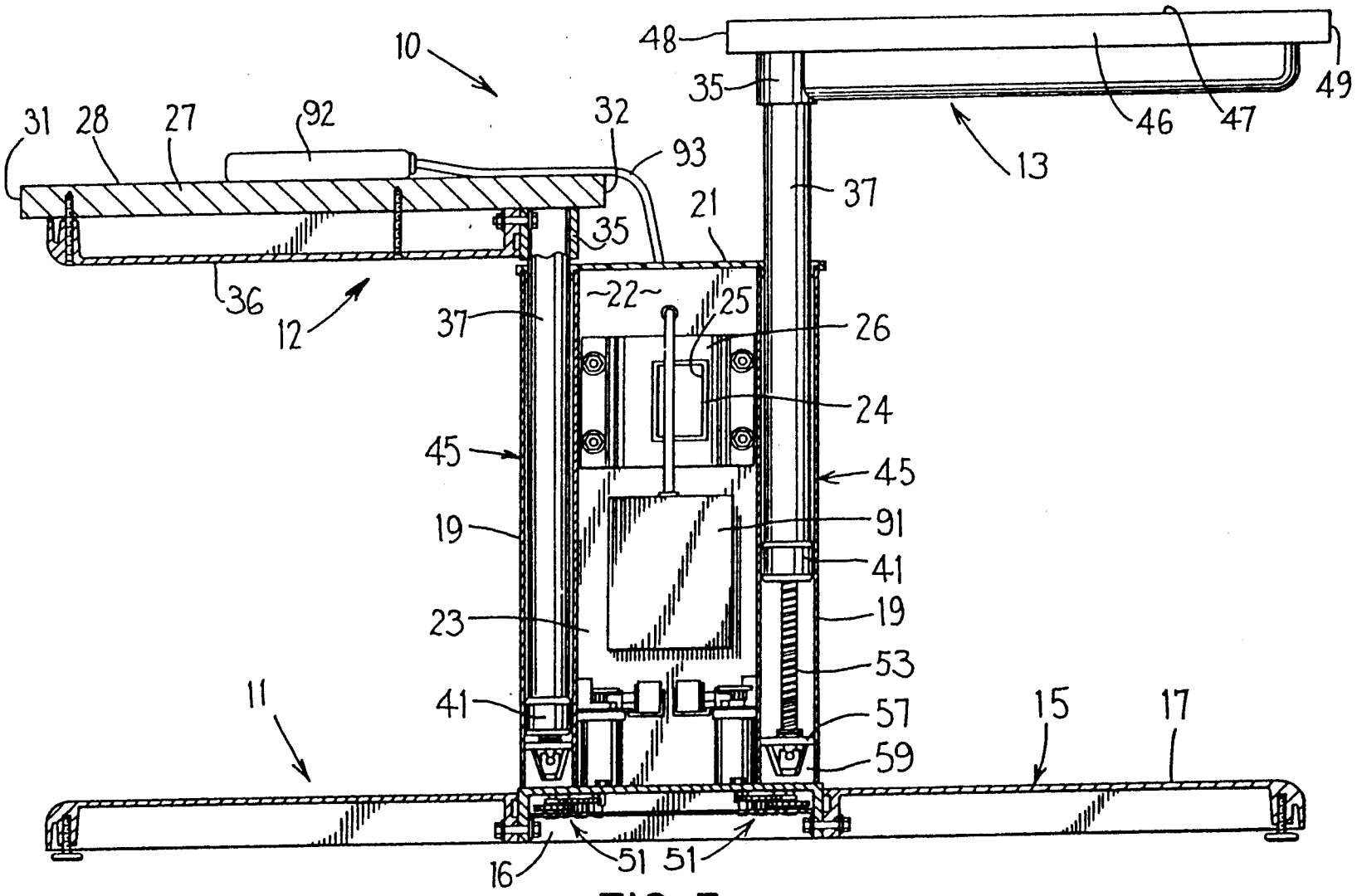
FIG. 3 is an end elevational view taken substantially along line 3—3 in FIG. 2.

Referring to FIGS. 1-3, there is illustrated a table or work station arrangement 10 according to the present invention, which arrangement includes a base assembly 11 having respective front and back top assemblies 12 and 13 mounted thereon for independent height adjustment, as explained hereinafter.

The base assembly 11 includes a pair of generally parallel and horizontally elongate legs 15 which are disposed adjacent opposite side edges of the table arrangement so as to extend generally in the front-to-back direction. These legs 15 each bear directly on a support surface such as a floor, and include a horizontally elongate center housing 16 having a pair of elongate leg elements 17 fixed to and projecting outwardly from opposite ends thereof.

Each leg 15 has a pedestal structure 18 fixed to and projecting vertically upwardly from the center housing 16, whereby the pedestal structures 18 project vertically upwardly in generally parallel relationship adjacent opposite sides (i.e. ends) of the table arrangement. Each pedestal structure 18 includes a pair of outer legs 19 (FIG. 3) which are fixed to the center housing 16 adjacent opposite ends thereof and project vertically upwardly in parallel relationship. The pair of legs 19 as associated with the same pedestal structure 18 are spaced apart in the front-to-back direction so that the front leg 19 is associated with solely the front top assembly 12, whereas the rear leg 19 is associated with solely the rear top assembly 13. Each of the outer legs 19 is preferably constructed as a hollow tube and define therein a vertically elongate inner opening which opens outwardly through the upper end of the respective leg. Each pedestal 18 is vertically enclosed by a removable two-piece tubular sheath 22 which is horizontally elongate in cross section and extends between and around the outer sides of the legs 19 so as to enclose same. This sheath 22 hence defines therein, between the legs 19, a narrow compartment 23 having a sideward width which substantially corresponds to the diameter of the legs 19. The upper ends of the adjacent pair of outer legs 19 are rigidly joined together by a removable top cap 21, which cap closes off the upper end of the compartment 23.

The base assembly 11 also includes a cross beam 24 which extends horizontally between and has opposite ends thereof fixedly joined to the upright pedestal structures 18 in the vicinity of the upper ends thereof. This cross beam 24 is preferably of a hollow tubular cross section so as to define an opening 25 extending therethrough for communication with the compartments 23 defined in the pedestals. The cross beam 24 has flanges 26 at opposite ends thereof which is fixedly attached, as by bolts, to additional flanges fixed to the outer legs 19.

Considering now the front top assembly 12, it includes a platelike top 27 which defines thereon a planar and substantially horizontally enlarged upper surface 28 adapted for use as a worksurface, such as for supporting a computer keyboard. This front top 27 is defined between generally parallel front and rear edges 31 and 32, respectively, which extend between generally parallel right and left end or side edges 33 and 34, respectively.

A pair of substantially tubular support hubs 35 are fixedly secured to and projecting downwardly from the underside of the front top 27 in the vicinity of the rear corners thereof. A horizontally elongate support arm 36 is fixed to and projects forwardly from each support hub 35, which support arm 36 is in contact with and fixedly secured to the underside of the front top 27 so as to provide a cantilevered support therefor. Each of the support hubs 35 has the upper end of a vertically elongate inner tubular leg 37 fixedly secured thereto, which inner leg 37 projects downwardly in cantilevered relationship for telescopic engagement within a respective one of the outer legs 19. For this purpose the top cap 21 has an opening 38 therethrough which is surrounded by an annular bearing or bushing portion 39 formed integrally with the top cap, whereby the bearing portion 39 is disposed within the upper end of the outer leg 19 so as to provide a slidable but supportive bearing engagement with the respective inner leg 37.

Figure 5:
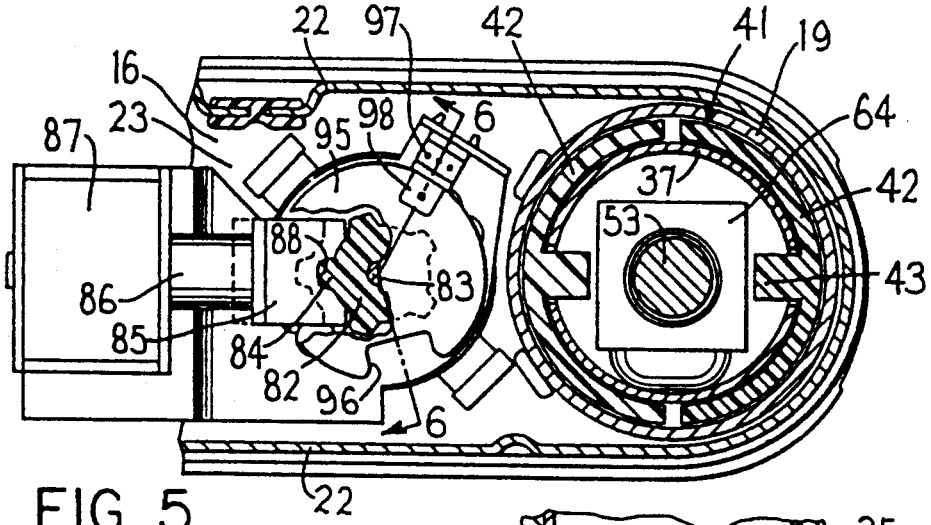
FIG. 5 is a fragmentary sectional view taken substantially along line 5—5 in FIG. 4.

The lower end of each inner leg 37 is also provided with an annular bushing or bearing 41 mounted adjacent the lower free end thereof for supportive but slidable engagement within the interior of the respective outer leg 19. This bearing 41 is preferably constructed from separate and generally opposed bearing halves 42 (FIGS. 4 and 5) which are of arcuate configuration and extend through approximately 180°, with the halves being designed to surroundingly enclose the inner leg 37 adjacent the lower free end thereof. Each of the bearing halves 42 has a blocklike projection 43 which extends radially inwardly thereof so as to project through a respective one of a pair of diametrically opposed openings 44 formed through the sidewall of the leg 37 so as to provide a securement of the bearing halves to the inner leg 37 when the latter is slidably confined within the outer leg 19.

The vertical telescoping of each inner leg 37 into a respective outer leg 19 defines a vertically-extendible telescopic leg assembly 45, with two such leg assemblies being associated with the front top 27, namely one adjacent the right rear corner thereof, and the other adjacent the left rear corner thereof. Two such telescopic leg assemblies 45 are also associated with the rear top 46, one of which is located adjacent each of the left and right front corners thereof. The rear top 46 is of generally similar construction to the front top in that it defines thereon a generally planar and horizontally enlarged upper surface 47 which extends respectively between substantially parallel front and rear edges 48 and 49, which front edge 48 is normally spaced rearwardly a small distance from the rear edge 32 of the front top so as to prevent interference between the two tops.

Figure 4:
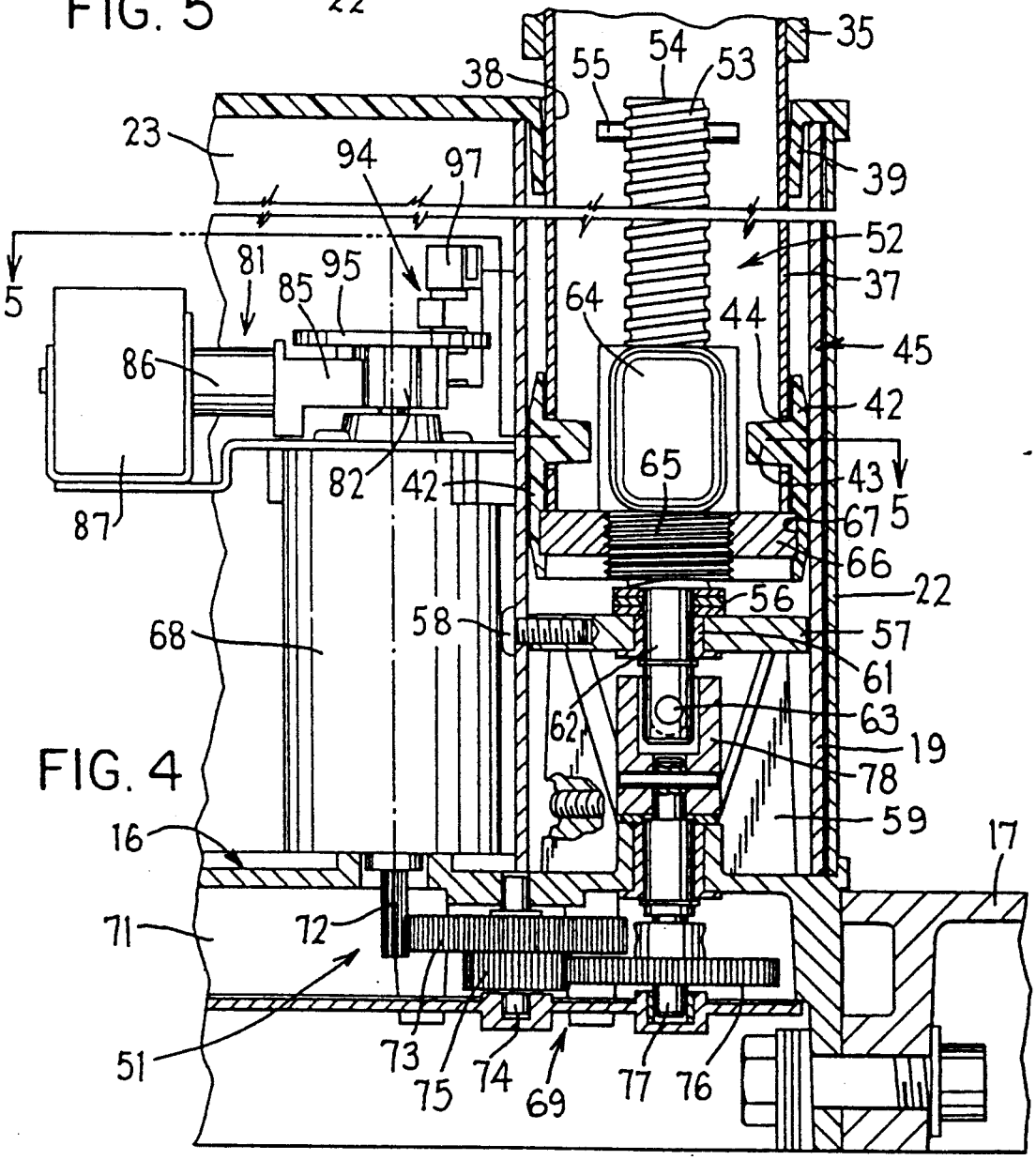
FIG. 4 is an enlarged, fragmentary sectional view of the power-driven extendible pedestal or post arrangement for the table top.

Each telescopic leg assembly 45 has its own powered driving arrangement 51 (FIGS. 3 and 4) associated therewith which, as illustrated in FIG. 4, includes a screw-nut drive unit 52 cooperating between the telescopic legs 19 and 37 for converting rotary drive motion into linear output motion. This drive unit 52 includes a vertically elongate drive screw 53 which projects vertically upwardly in cantilevered relationship along the interior of the lower leg 19 and terminates in a free upper end 54 disposed adjacent the upper end of the leg 19, which free end is provided with a stop 55 associated therewith. The upper free end 54 of screw 53 is free of support from the surrounding legs 19 and 37. This drive screw 53, at its lower end, abuts against a thrust bearing 56 which in turn abuts against an upper surface of a support plate 57, the latter being fixedly secured to the lower leg 19, as by a screw 58. This support plate 57 bears against the upper surface of a pedestal-like support 59 which is fixed to and projects upwardly from the central housing 16 so as to effectively pilot into the lower end of the lower leg 19.

Support plate 57 centrally mounts therein a bushing 61 through which projects the lower reduced-diameter drive hub 62 of the screw 53. This drive hub 62 has a drive pin 63 mounted diametrically thereacross so as to project radially outwardly in opposite directions.

The drive unit 52 also includes a nut assembly 64, such as a conventional recirculating ball nut, disposed for engagement with the rotatable screw 53. The nut assembly 64 is nonrotatably confined between the diametrically opposed projections 43 defined on the bushing halves 42. Nut assembly 64 also has a threaded hub 65 which is nonrotatably secured to a surrounding end plate 66, the latter being directly engaged against the lower end of the upper leg 37. This end plate 66 has the outer periphery thereof confined within an undercut groove 67 defined within the bearing 41.

To effect rotational driving of the screw 53, the drive arrangement 51 includes a reversible drive motor 68, preferably a small low-voltage (i.e., 36 volt) direct-current motor. This drive motor 68 is mounted directly on the center housing 16 so as to be disposed within the pedestal compartment 23 substantially adjacent the respective lower leg 19. The output of motor 62 is interconnected to the screw shaft 53 through a speed-reducing gear train 60 which is disposed within a compartment 71 as defined within the central housing 16. This gear train includes a driving pinion 72 secured to the motor shaft and maintained in direct driving engagement with an intermediate gear 73 mounted on an intermediate idler shaft 74. Gear 73 has coaxially fixed thereto a small-diameter driving gear 75 which directly meshes with an output gear 76 which is nonrotatably mounted on a driving shaft 77. The shaft 77 is rotatably supported on the central housing in vertical coaxial alignment with the screw 53. Driving shaft 77 projects coaxially upwardly into the interior of the support 59 and has a yokelike drive coupling member 78 secured thereto, the latter having a diametral slot opening axially upwardly thereof so as to enable the drive end 62, 63 of the screw to be axially and nonrotatably engaged therewith. This creates a driving connection which can be readily axially separated if necessary.

The drive arrangement 51 also has a brake mechanism 81 associated therewith to prevent backward driving of the motor and hence lowering of the table, such as caused by loading of the table when the motor is stopped. This brake mechanism includes a brake wheel 82 preferably secured directly to the motor shaft 83, which securement is to the upper end of the motor shaft in the illustrated embodiment. This brake wheel preferably includes several radially outwardly projecting brake lugs 84 associated therewith in circumferentially spaced relationship therearound, the number of such lugs preferably being at least three, and more preferably at least five spaced substantially uniformly around the periphery of the brake wheel. These lugs are adapted to cooperate with a brake member 85 which is linearly reciprocally movable generally radially of the brake wheel. This brake member 85 is secured to the outer end of a plunger 86 associated with a conventional electrically actuated solenoid 87. The plunger 86 is normally retracted into a released dotted-line position when the solenoid is energized, with the plunger 86 and brake member 85 being moved radially into a braking or engaged position by the action of springs (not shown) when the solenoid is de-energized.

The brake member 85 has a lug-receiving slot or groove 88 therein and configured so as to receive one of the lugs 84 to restrain rotation of the brake wheel and of the motor shaft secured thereto. The brake lugs 84 and the brake slot 88 are both provided with sloped camlike profiles on opposite sides thereof so as to effect automatic cammed entry of the lug 84 into the slot 88 even though they may not be properly aligned as the brake member moves radially inwardly to its engaged position. The sides and configuration of the slot 88, particularly the enlarged mouth of the slot and the cam profiles formed on both sides thereof, coupled with the configuration and angular spacing between the lugs 84, is such as to ensure that, irrespective of the stopping position of the brake wheel 82, at least one of the cam lugs 84 will always be disposed for engagement with the wide camlike mouth of the slot 88 so as to effect angular camming of the brake wheel into a position of full engagement with the slot 88. Further, the solenoid 87 is de-energized so as to permit brake engagement at a time when the brake wheel 82 has sufficiently slowed down, but not yet fully stopped, as to ensure that one of the lugs 84 will properly register with the slot 88 to permit full engagement of the brake.

To provide for synchronized control of the pair of motors 68 which are associated with the right and left telescopic leg assemblies of each table when raising or lowering the respective table, there is provided a controller 91 which is preferably mounted within one of the pedestal compartments 23 for controlling energization of the motor pair associated with the table being raised or lowered. This controller 91 in turn is preferably activated from a pendant-type keypad control 92 which can be positioned for convenient access by an operator such as on the front top 27, with the control 92, being joined to the controller through a suitable flexible low-voltage cable 93. The pendant controller 92 is of a multiple-key construction for actuation by an operator so as to provide control over the selection and movement of the individual table tops. The electrical energy, preferably low-voltage direct-current energy, is supplied to the controller 91 and control 92 from a transformer which is preferably mounted in the interior compartment of the other pedestal, which transformer in turn has an exteriorly extending supply cord (not shown) adapted for plug-type connection to a conventional electrical receptacle.

Figure 6:
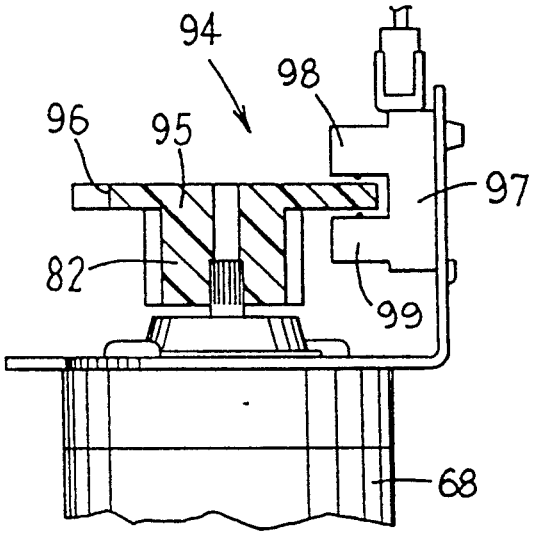
FIG. 6 is a fragmentary sectional view taken substantially along line 6—6 in FIG. 5.

To enable the controller 91 to control and synchronize the rotation of the energized motors 68 to maintain the table top in a substantially level condition and at the same time permit movement of the table top to various predetermined heights, as explained in detail hereinafter, each drive arrangement 51 has a rotation sensing and signal generating assembly 94 (FIGS. 4–6) associated therewith. This assembly 94 includes a counting wheel or disc 95 which is fixed to and rotates with the brake wheel 82. Counting wheel 95 has a slot 96 extending axially therethrough over a predetermined radial extent of the wheel periphery. A photocell-type sensor 97 is stationarily mounted adjacent the counting wheel 95 and includes an emitter portion 98 disposed adjacent one axial side of the counting wheel and a receiver portion 99 disposed adjacent the other axial side, whereby the sensor 97 transmit one signal per motor revolution each time the slot 96 passes between the emitter and receiver portions.

Figure 7:
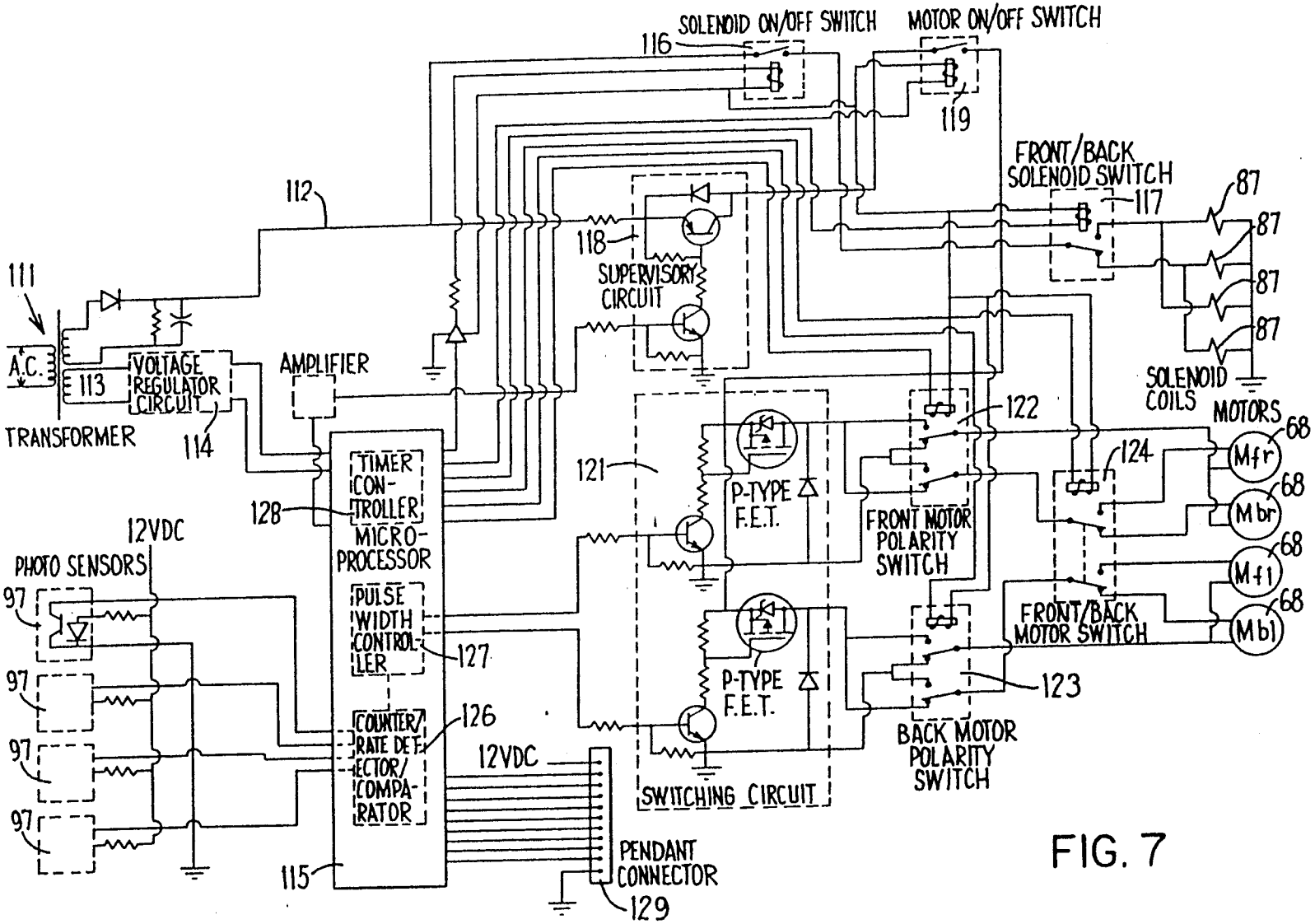
FIG. 7 schematically shows circuitry for the table controller.

Referencing now FIG. 7, there is diagrammatically illustrated electrical circuitry associated with the controller 91 for controlling energization of the motors 68 and the associated brake solenoids 87. As illustrated by FIG. 7, the table possesses four separate motors 68, namely the right and left motors ($M_{fr}$, $M_{fl}$) associated with the front table, and the right and left motors ($M_{br}$, $M_{bl}$) associated with the rear table. Each of these motors has a brake solenoid 87 and a photosensor 97 associated therewith, all being diagrammatically depicted in FIG. 7.

Conventional alternating-current electrical energy is supplied to a transformer 111 located in one of the pedestal compartments. The transformer 111, in the illustrated embodiment, has a split secondary so as to provide a first higher-voltage direct current driving circuit 112, such as a 36 volt DC circuit. The transformer also provides a second lower-voltage DC circuit 113 which is supplied to a suitable voltage regulator circuit 114 from which multiple DC voltage taps of different voltage can be provided. The output from the regulator circuit is also supplied to a microprocessor 115.

The voltage from the driver circuit 112 is supplied through a first branch circuit to the brake solenoids 87 and, for this purpose, the driver circuit includes therein a main solenoid on-off relay switch 116 which, when in the normally open position, prevents energization of any of the solenoids 87. With this switch 116 in a closed position, however, then the driver voltage is supplied to a further series-connected double-pole relay switch 117 which controls selection of the front and back solenoids. That is, the switch 117 in one position permits solely the two solenoids 87 associated with the front table to be energized, whereas this switch 117 in the other position enables solely the two solenoids 87 associated with the back table to be energized.

The driver circuit 112 also connects to a second branch circuit for supplying driving voltage to the motors 68. This branch of the driver circuit 112 connects to a supervisory circuit 118 which is capable of switching a DC voltage output to supply power to the motors if the microprocessor is operating in a normal mode. The output from this supervisory circuit 118 is connected to a main motor on-off relay switch 119 which, in the normally open position, prevents flow of DC voltage to any of the motors 68. The output side of this main on-off switch 119 in turn is connected to a pulse modulator switching circuit 121 which includes parallel branches and receives appropriate input signals from a pulse width controller 127 associated with the microprocessor 115 for varying the motor supply voltage. More specifically, this switching circuit 121 turns on and off as a function of the signals received from pulse width generator 127 so as to create a wave form or pulsed DC voltage output in each branch circuit which is connected respectively to one of a further pair of parallel-arranged polarity switches 122 and 123. The polarity switch 122 controls solely the pair of motors associated with the front top, whereas the polarity switch 123 controls solely the pair of the motors associated with the back table top. Each of these switches 122, 123 is of a double-pole relay construction so that it causes the associated pair of motors to rotate in a first direction when in one position to cause upward table top movement, whereas the motors are caused to rotate in the other direction when the switch is in the second position so as to effect lowering of the respective table top. The outputs from switches 122 and 123 are then fed to a front/back relay motor switch 124 which is also a two-position or double-pole switch, one position being coupled to solely the pair of motors associated with the front table top, the other position being coupled solely to the pair of motors associated with the back table top.

The microprocessor 115 includes therein a counting/detecting/comparing means 126 which receives input signals from the four photosensors 97, which sensors individually emit a signal per rotation of the respective motor 68. The signals inputted into the counter 126 are counted for each motor so as to define the position or height of the upper table leg associated with the respective motor. In this regard, the counter has a "zero" electronic count position which substantially corresponds to the lowest table height position (for example 26 inches), and the counter has an internally defined record which relates the number of counts to predefined table height positions. The counter continuously adds to or subtracts from the count for each motor as the associated upper leg is raised or lowered by the respective motor so as to determine the table height. The signal input rate received from the pair of photosensors 97 associated with the pair of energized motors are also compared in the counter/comparator 126. If the signal rates are different due to one motor running faster than the other motor (such as due to the other motor being under a heavier load), then the counter/comparator 126 transmits an adjusting signal to the pulse width controller 127, which in turn adjusts the branch of the switching circuit 121 associated with the faster motor so as to adjust or modulate the width of the voltage pulse to reduce the average voltage of the output wave form supplied to the faster motor. This thus slows down the faster motor to a speed substantially equal to that of the slower motor.

The counter/rate detector/comparator circuit 126, as associated with the microprocessor, continuously monitors the pulses or signals received from the photosensors 97 so as to count the number of rotations received from each photosensor, and also monitors the signal rate received from each photosensor and compares both the total counts and the signal rates of the two photocells associated with the pair of energized motors so as to control both the speed and position of motor shaft rotation associated with the energized motors, so that the table top is maintained in a horizontal and level condition. For example, when the top is being moved (for example raised) from a first height to a second height, both the right and left motors are energized but may rotate at slightly different speeds such as due to an unbalanced load being positioned on the table more directly over one of the motors. Hence, to move from the first height to the second height requires a substantially equal number of predetermined counts (i.e., motor revolutions) for each motor, and this counting information is monitored by the circuit 126. If one motor is rotating faster, which is indicated by the monitoring and comparing of the count rates by the circuit 126, then the circuit 126 will detect this difference and emit a correcting signal to the controller 127 which in turn controls the switching circuit 121 to slow down the faster motor. However, since the total revolutions and hence total counts associated with the faster motor will still be greater than that of the slower motor, even after the faster motor is slowed down to a speed substantially equal to that of the slower motor, the circuit 126 also monitors the total counts associated with the two motors and makes an adjustment to still further slow down the motor having the higher count (originally the faster motor) until the motor having the smaller count catches up, whereupon circuit 126 again restores speed equality to the two motors so as to maintain the table top in a horizontal level condition. While theoretically the circuit is designed to maintain such equality particularly with respect to the counts associated with the pair of energized motors, nevertheless in practicality the circuit 126 will provide a small tolerance (which will be only a small number of counts) necessary in order to permit practical operation of this system without having any significant effect on the desired horizontal level condition of the table top.

The controller 91 is provided with a pendant connector 129 which couples to the microprocessor 115 for supplying numerous signals thereto as inputted by the operator depressing the keys of the pendant control 92. The microprocessor 115 also includes a timing and controller circuit 128 for transmitting control signals to shifting solenoids associated with the switches 116, 117, 119, 122, 123 and 124. These control signals from the microprocessor control the timing and shifting of the respective switches. For example, these signals control and coordinate the energization and de-energization of the solenoids 87 with respect to the corresponding motors 68.

Figure 8:
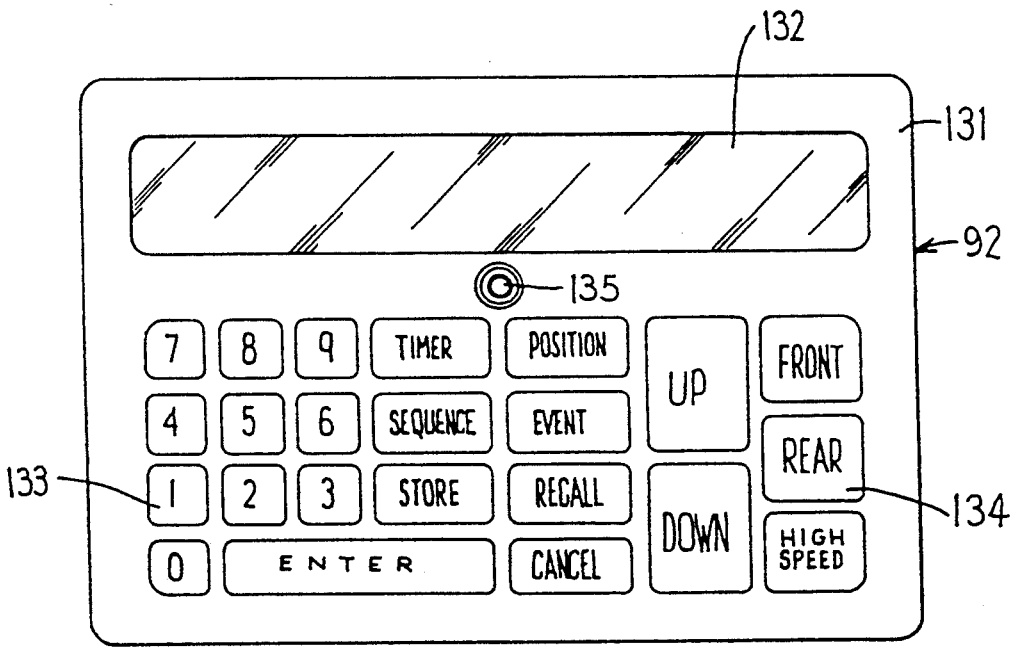
FIG. 8 is a top view of a preferred pendant-type keypad control for the controller.

The pendant control 92, a preferred embodiment of which is illustrated by FIG. 8, is constructed as a small portable unit resembling a thin boxlike housing having a display screen 132 on the upper surface thereof. The pendant control 92 also preferably has a visual indicator 135, such as an LED. The upper surface of the pendant 92 is also provided with a plurality of keys for inputting information or commands, including a plurality of numeric function keys 133 and a plurality of operations keys 134, which keys have their functions defined thereon as shown in FIG. 8, and as explained hereinafter.

As to the visual display means 132 (FIG. 9), it includes a first display 136 entitled SEQUENCE, a second display 137 entitled EVENT, and a third display entitled POSITION. These displays are positioned in sidewardly adjacent relationship, and each has an icon associated therewith at the position indicated by dotted lines 139 in FIG. 9, which icon when energized states STORED.

The visual displays means 132 also includes a fourth enlarged display 141 located substantially in the middle of the overall display area. This display 141 includes upper and lower display regions in which the words REAR and FRONT permanently appear. Numeric height displays are positioned to appear in the upper and lower regions so as to indicate the heights (in inches or centimeters) of the respective rear and front table tops.

Lastly, the visual display means 132 includes a fifth display 142 adjacent the rightward side thereof, which display 142 indicates the function of a timer and can display hours and minutes. Four separate and independently energizable icons are disposed directly below the display 142, which icons are in the positions indicated by dotted line at 143, 144, 145 and 146. The icon 143 when energized states PRESS STORE, icon 144 when energized indicates PRESS ENTER, icon 145 when energized states TO CONTINUE, and icon 146 when energized states PRESS EVENT.

The functions associated with the keys of the pendant control 92 are associated with and operate a program which is associated with the controller 91 so as to provide for programmed operation of the table arrangement and hence permit front and rear tops to be positioned at numerous height locations, which locations can be stored in the memory of the program, with the locations being recallable either individually or in a predetermined sequence, as explained below.

Figure 10:
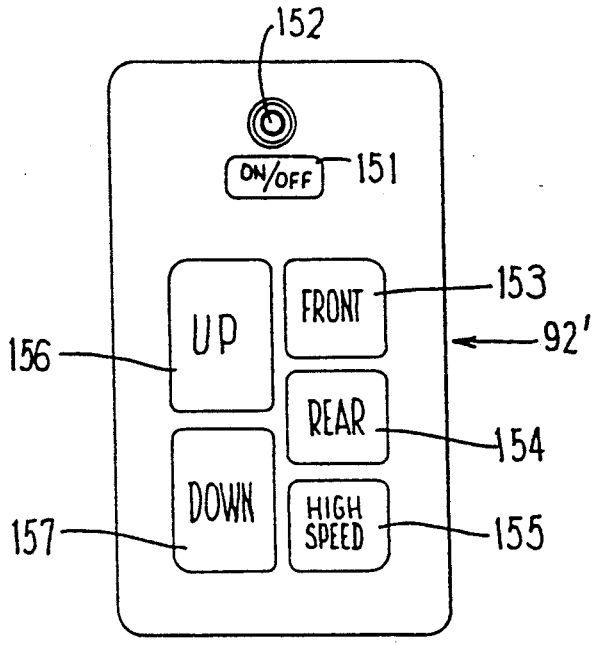
FIG. 10 is a view similar to FIG. 8 but illustrating a modified pendant-type keypad control.

However, if programmed control of the table tops is not desired, then the table arrangement can be provided with a modified pendant control 92' as illustrated by FIG. 10, which pendant control 92' provides a FRONT key 153 for activating the motors associated with the front top, a REAR key 154 for activating the motors associated with the rear top, a HIGH SPEED key 155 for activating the motors at high speed, rather than the normal low speed activation which would otherwise occur, an UP key 156 when raising of a selected top is desired, and a DOWN key 157 for lowering the selected top. The switch 151 merely activates the control 92', and indicator light 153 is energized when switch 151 is ON. With this pendant control 92', the operator manually controls all raising and lowering functions of the table. The operator selects which table is to be moved by depressing either the FRONT key 153 or the REAR key 154. Thereafter, assuming high speed is desired, the operator then depresses the HIGH SPEED key 155. The operator then manually depresses UP key 156 or DOWN key 157 and maintains the selected key depressed until the selected top is respectively raised or lowered to the desired position.

The operation of the table arrangement 10, particularly when using the pendant controller 92' of FIG. 10, will be briefly described to ensure a thorough understanding thereof.

When a computer is supported on the table arrangement 10, the keyboard will normally be positioned on the front top 27, and the CRT or screen will normally be positioned on the rear top 46. When a change in the elevation of one or both tops is desired, the operator depresses the ON key 151 to activate the control 92'. The operator then depresses the selected table button, such as the REAR key 154 which will result in activation of the front/back solenoid switch 117 and front-/back motor switch 124. The operator will then normally depress the HIGH SPEED key 155 to cause high speed motor operation, if such is desired. The operator will thereafter depress either the UP key 156 or the DOWN 157 depending on the desired direction of table movement. This hence controls the switches 116, 119, 122 and 123 so as to permit energization of the brake solenoids 87 associated with the top table motors to release the brake members 85 from the brake wheels 82, and energization of only the pair of motors associated with the selected rear top table so as to cause the selected upward or downward movement of the table top.

During energization of the motors, the motors drivingly act through the gear train 69 and the disengageable coupling 63, 78 to effect rotation of the upwardly-cantilevered drive screw 53. This screw 53 cooperates with the nut 64, which is constrained from rotating, whereby the nut 64 is linearly displaced either upwardly or downwardly depending upon the direction of rotation, thereby causing a corresponding vertical telescopic displacement of the inner leg 37 within the outer leg 19. During the slidable vertical displacement of the inner leg 37, the lower bearing 41 maintains a slidable engagement with the inner wall of the outer leg 19, and at the same time the top bearing 39 maintains a slidable engagement with the outer wall of the inner leg 37.

During rotation of the pair of drive motors 68, the photocell 97 associated with each rotating motor transmits a signal for each motor revolution to the counter/-comparator 126 which counts and compares the rate of signals from the two photocells associated with the pair of energized motors. If the motor rotational rates are different, such as due to one side of the table being more heavily loaded than the other so as to cause slow down of one of the motors, then the counter/comparator 126 transmits a corrective signal to the pulse width controller 127 so as to adjust the switching circuit 121 to modulate or adjust the wave form and hence adjust the average voltage which is supplied to the higher speed motor, thereby reducing the speed of the higher speed motor so as to equalize right-to-left table elevations and the rates of change thereof, so that the two telescopic legs associated with the moving top (such as the rear top) are simultaneously and synchronously extended or contracted. In addition, the counter electronically counts the number of signals received during the rotational cycle of each of the activated motors and, upon receiving a stoppage or "off" signal, automatically causes continued operation of one motor for a short additional time period if necessary so as to cause both motors to preferably undergo an equal number of revolutions, thereby ensuring that the table top remains horizontal. The rotation of both motors continues long as the operator maintains the selected key 156 or 157 depressed, with release of the key terminating motor operation. Termination of motor operation de-energizes, after a predetermined time delay, the respective solenoids and permits the brake members 85 to re-engage the respective brake wheels 82.

Figure 9:
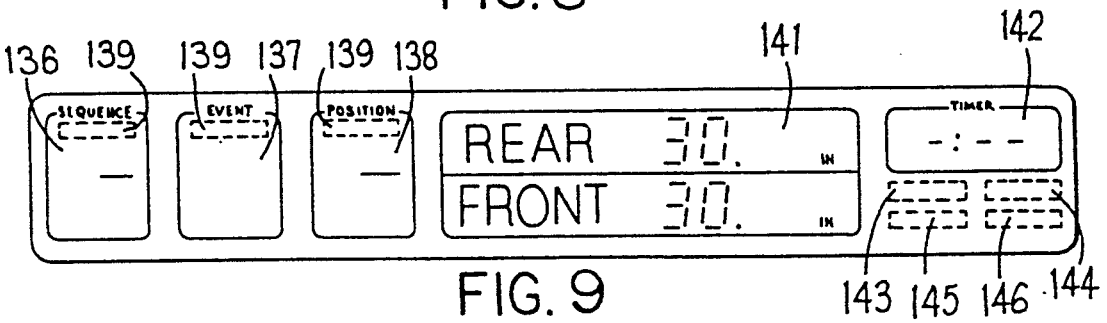
FIG. 9 diagrammatically illustrates, on an enlarged scale, the readout or screen associated with the control of FIG. 8.

The operation of the table arrangement to provide for programmed control over table heights, particularly when using the pendant control 92 of FIGS. 8 and 9, will now be described, particularly with reference to FIGS. 11(A) and 11(B) which diagrammatically illustrate programming and operating the table.

The front and rear tops 27, 46 of the table are movable individually and independently through a significant vertical extent, typically from a lowermost position which is about 26 inches above the floor surface, to an uppermost position which is about 42 inches above the floor. In addition, with the table tops in their lowermost positions, the microprocessor 115 defines an electronic "zero" count position, whereupon there is defined in the microprocessor a "position table" whereby each height of each top, in predetermined height increments which are preferably about ½ inch increments, is defined according to a predetermined number of counts, which counts corresponds to a predetermined number of motor revolutions.

Figure 11A:
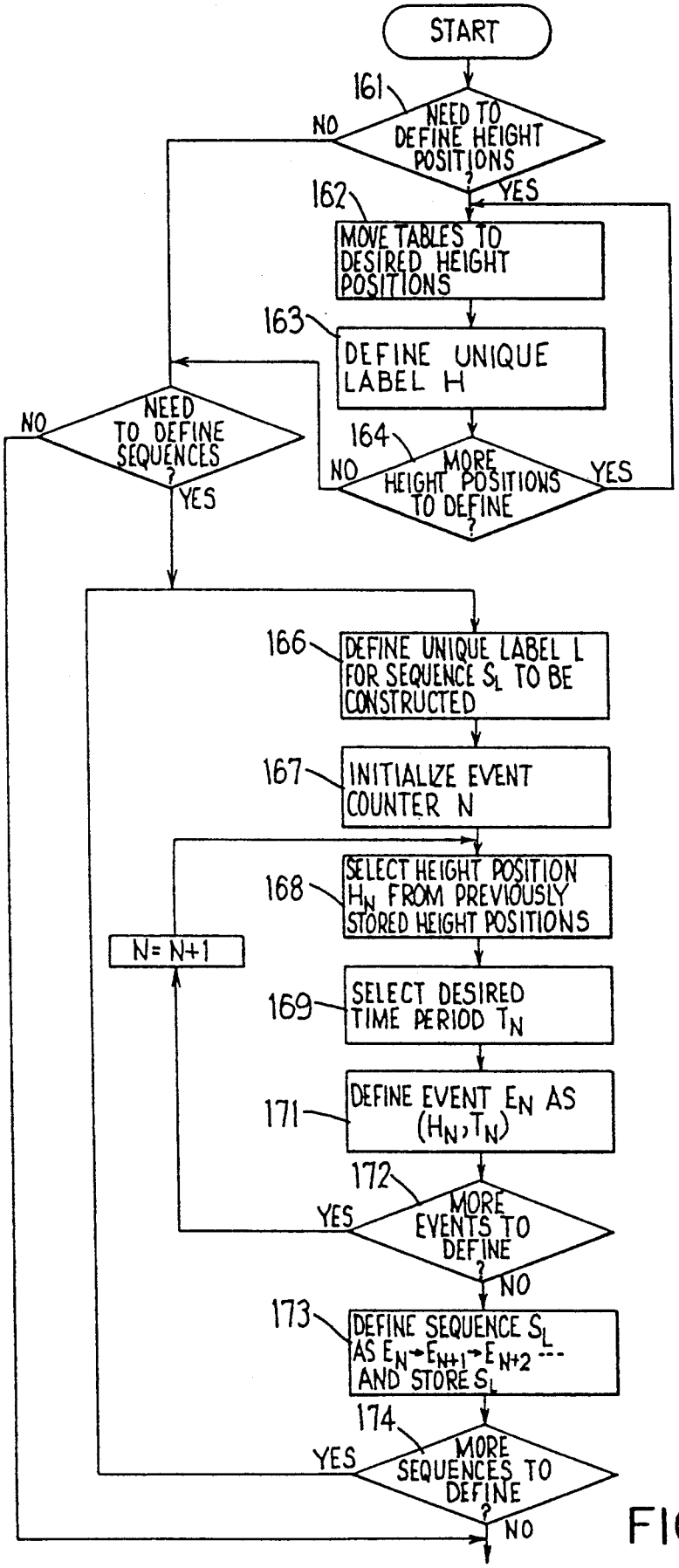
FIGS. 11(A) and 11(B) are flow charts which illustrates the programming of the controller and the operating of the table arrangement thereby.

Referencing now the programming of the table arrangement 10 as illustrated by the step chart of FIG. 11(A), the operator first determines whether there is a desire to program one or more predetermined height positions or locations, as indicated at step 161. Since such is normally desired, the operator then goes to step 162 so as to permit creation of a desired table height position H. To create a predetermined table height position, the operator initially moves the rear top 47 to the desired height position by depressing the REAR key, then thereafter normally depressing the HIGH SPEED key, and then depressing and maintaining depressed the UP or DOWN key until the rear top reaches the desired height. During movement of the rear top, the instantaneous top height will appear in the upper portion of the display 141, and the operator will maintain the UP or DOWN key depressed until reaching the desired height which will be displayed at 141. The operator will then activate the FRONT button, followed by activation of the HIGH SPEED key, followed by activation and continued depression of the UP or DOWN key to cause vertical displacement of the front top. As the front top is displaced, the height thereof will be instantaneously displayed in the lower portion of the display 141, and the operator will continue movement until the top reaches the desired height, and the display 141 will indicate the new height. At that time the operator will then depress the POSITION key and assign a unique label to this position by depressing one of the numeric keys 133, such as by labeling this position "1". The operator then depresses the STORE key so as to store the predetermined table height H, which predetermined height represents two height values, one for each of the front and rear tops. If the operator does not depress the STORE key within a predetermined number of seconds following entry of the position label, then the icon 139 will flash the prompt "press store" so as to guide the operator as to the required next step. If STORE is not depressed within a predetermined time period, then the visual display will go static.

After the operator has pressed STORE so as to complete step 163, the operator then determines whether creation and storage of additional height positions is desired, as indicated at step 164. Since normally several height positions are desired, the operator will then return and go through the same sequence as indicated at steps 162 and 163 until the desired number of different predetermined height positions have been defined and stored, each being stored under a different or unique label (i.e., a different numeric identification for the height position).

If nothing further is required other than storage of several predetermined height positions, then the operator can resume normal use and operation of the table, including manually controlled raising and lowering of the front and rear tables as desired. Alternatively, the operator can recall any predetermined and stored height position by operation in the manner outlined in FIG. 11(B), explained below.

In addition, and again referring to FIG. 11(A), the operator can also program a sequence of table events, whereby each event represents a predetermined table height (two height values, one for each of the front and rear tops) in combination with a determined time interval during which the tops are maintained at the predetermined height. A plurality of such events can be defined and then programmed into a desired sequence so as to ensure that the front and rear tops will be positioned and moved so as to provide for greater flexibility and yet still provide control over operator movements and positions.

To create a sequence of table events, the operator depresses the SEQUENCE key and then defines a unique identifying label L for the sequence as indicated at step 166, which label L will be a numeric label effected by depressing one of the numeric keys 133, such as by labeling the sequence "1". This then causes the "event" function of the microprocessor to be automatically activated and in fact the EVENT display 137 is initially assigned the identification "1" to designate the first event. The POSITION function is then also automatically activated by the microprocessor and, as indicated at step 168, the operator then selects one of the previously-stored height position $H_n$ by inputting (by depressing the selected numeric key 133) the numeric label or identification for the selected height position, which label appears in display 139. The heights corresponding to the label also appear in display 141. If this is not the right position, the operator can, in a timed sequence, scroll through the stored height positions by inputting different position numbers through activation of the numeric keys 133. When the operator locates the desired height position by inspection of the visual display 141, the operator waits the predetermined time whereupon the microprocessor 115 automatically activates the timer function and, as indicated at step 169, the operator keys in, by sequential depression of the numeric keys 133, the desired time interval for maintaining the table tops at the selected height $H_n$, which time will visually appear in display 142. This selected time, in combination with the selected predetermined height position, define a single table event.

If the operator wishes to define additional events in the sequence (step 172), then the operator depresses the EVENT key so as to store in the microprocessor the previously defined event or, if the operator takes no action for a predetermined short time interval, then the icons 145–146 both flash stating "to continue press event". If the operator again takes no action within a predetermined time interval, icons 145–146 are de-energized and icon 144 is energized to flash "press store". If the operator still takes no action within a predetermined time, then the display returns to its original static condition.

After the operator presses the EVENT key so as to store the previously defined event function, then the icon 139 is energized so that STORED momentarily appears is display areas 137 and 138. Then the microprocessor automatically presents the next event number (such as "2"), in the display 137, and then thereafter automatically activates the "position function". The operator then repeats steps 168 through 171 by depressing one of the numeric keys 133 to input a different height label $H_{n+1}$ corresponding to another predetermined stored height position (the height values of which then appear on the display 141), and then inputs a desired time interval for use with this height position.

If no more events are desired in the sequence, the operator then depresses the STORE key (step 173) which stores all of the information which defines each event and also stores the entire sequence of events for later recall. The icon 139 associated with each of displays 136–138 is then energized for a short period of time to indicate "stored". The overall display 132 then returns to a static mode and the heights displayed in area 141 correspond to the actual heights of the table tops.

If the operator desires to define a further sequence as indicated at step 174, then the operator again repeats steps 166–173, with the primary different being that the operator will define the next sequence by means a unique label $S_t$ as indicated at step 166, such as by identifying it as sequence "2".

On the other hand, if no more sequences are desired, then the programming function is ended, and the operator can resume operation of the table in the desired manner.

Figure 11B:
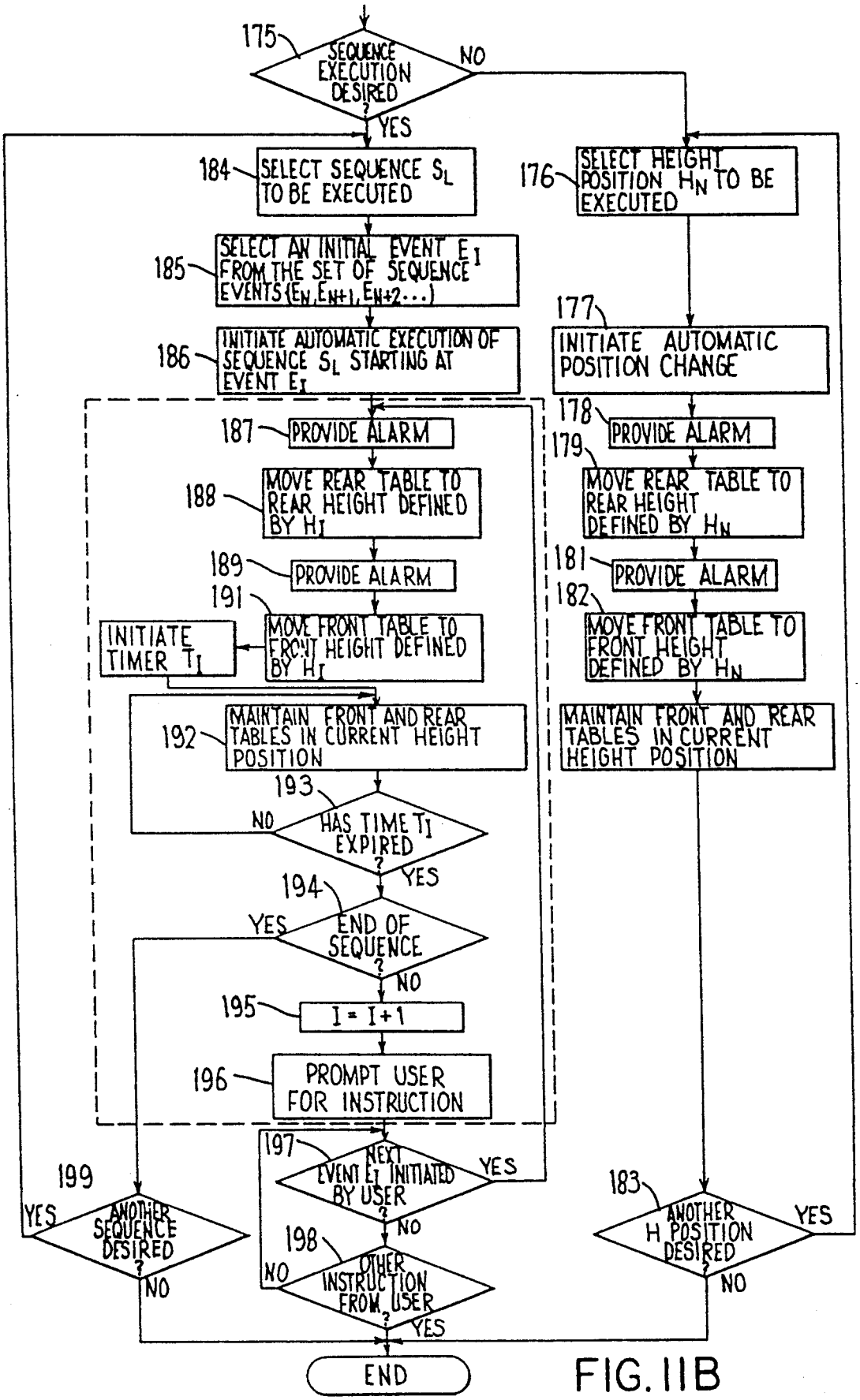

Referring now to FIG. 11(B), the activation of the table utilizing programmed height positions, either individual positions or sequenced table events, will now be explained.

If the operator determines that utilization of a stored sequence is not desired as indicated at step 175, then as indicated at step 176 the operator selects a desired stored height position $H_n$ by depressing the RECALL key followed by depression of the POSITION key. The operator then selects the desired stored position by depressing the appropriate numeric key 133, whereupon the position number will appear in the display 138, at which time the stored height values corresponding to this position will also appear in display 141. If this is not the right position, the operator can, in a timed sequence, scroll through the stored height positions by inputting different position numbers through activation of the numeric keys 133. When the operator locates the desired height position by inspection of the visual display 141, then the table is activated at step 177 by depression of the ENTER key. This causes the display 141 to return to the actual table height values, following which a visual and/or audible alarm (step 178) is emitted so as to alert the operator as to impending table movement. This includes activation of an audible alarm located in the pendant control 94, and flashing of the LED 132 on the pendant. Thereafter the brakes associated with the rear table motors are released and the rear motors are automatically energized (step 179) in the correct direction so as to effect raising or lowering of the rear top to the predetermined height. Upon reaching this position, the rear motors are automatically stopped and braked, whereupon a further visual and audible alarm (step 181) is automatically sounded, and thereafter the front top automatically moves (step 182) to the new predetermined height in the same manner as the rear top. Upon reaching this height, then the new heights for both tops are displayed at area 141, and the table tops then remain in this new height position until the operator elects to move them. Hence, after selecting the predetermined height position and activating the system, the actual movement of the table tops occurs automatically and requires no further input or control by the operator, and at the same time the display 141 automatically tracks and displays the heights of the tops as they are moved.

On the other hand, if the operator desires at step 175 to actuate a sequence of table events, then the operator first depresses the RECALL key followed by depression of the SEQUENCE key, and then depresses one of the numeric keys 133 corresponding to the selected sequence, which sequence number will appear in the display 136. Thereafter the first event will automatically be displayed (step 185) at the display 137, and the position identifying location, the position heights, and the time interval, all corresponding to the selected event, will be displayed in the remaining displays 137, 141 and 142.

If the operator wishes to start with some other event or merely review the data associated with the sequenced events, then the operator can press the EVENT key whereby the program will slowly scroll through the sequenced events and display the pertinent data (i.e., table heights and time) for each event.

When the operator has determined which event is to be initiated first, as indicated by the display 137, then the operator depresses the ENTER key (step 186) to activate the sequence, which activation will occur with the event displayed on the screen 132. At that time the existing table height position will reappear on the screen 132, the visual and audible alarms are then activated (step 187), and thereafter the rear top is automatically moved to the destination height (step 188), followed automatically by further activation of the audible and visual alarms (step 189), and then followed automatically by movement of the front top to the predefined destination height (step 191). With both tops positioned at the destination heights, which will be visually indicated at the display 141, the timer is then activated for maintaining the tops at these heights until the timer times out, which timing out function will be readily visible by inspection of the display 142. When the timer times out, then an audible/visual alarm is activated and the microprocessor automatically displays the next sequenced event (including the table heights and time) on the screen at areas 137, 138, 141 and 142 (step 195) and also flashes the LED 135, so as to indicate to the operator that the prior event has terminated, and to also provide the operator with visual identification as to the next event (both height position and time). At this time, the icons 143 and 145 are also energized and flash "press enter to continue". However, since the operator may be unable to immediately initiate the next table event, the table tops will remain at the prior event heights and the next event along with the prompts will continue to be displayed for a predetermined time, such as about five minutes. At that point in time, further prompts (step 196) are given to the operator, particularly in the form of an audible alarm. If after a predetermined time period the operator does not response, then the screen 132 goes static and displays the current table positions. However, if the operator does respond by pressing the ENTER key within the allowed time interval, then the next event is automatically actuated and hence the operations starting at step 187 again automatically repeat.

The table arrangement 10 can thus be programmed to provide a plurality of predetermined height positions, with the various predetermined height positions being coordinated with time intervals to define a plurality of table events which can be sequenced to permit positioning of the table tops sequentially in a plurality of desired positions so as to optimize operator comfort and health, with the table tops being automatically moved from position to position as each event of the sequence times out merely by requiring an input signal from the operator to permit initiation of the next event.

While the invention as described above illustrates use of a pendant keypad control 92 as a preferred embodiment for controlling the programmed operation of the table arrangement, it will be appreciated that other arrangements can also be provided for this purpose. For example, the control 92 could additionally be provided with a card reading slot and associated internal card reading capability so that a desired table movement sequence could be magnetically preprogrammed on a card (similar to a credit card) which could then be read into the control 92 so as to permit storage of the desired table arrangement sequence therein. With such a arrangement some of the programming keys on the control 92 could be eliminated if preprogamming solely by means of a magnetic card was desired.

As a still further alternative for both programming and controlling the table operation, the pendant control could be replaced by a central computer which would be connected to one or several such table arrangements so as to not only control but also monitor the positional arrangements thereof. In place of a central computer, it will be appreciated that the programming and controlling of the table arrangement could also be accomplished by utilizing the computer which is supported on the table whereby the computer operator could use his/her own keyboard for activating and programming the table arrangement.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a table having a horizontally enlarged top defining thereon a horizontally enlarged and upwardly facing worksurface, a pair of vertically elongate leg assemblies connected to said top at sidewardly spaced locations and projecting downwardly therefrom for supporting the top at selected heights above a support surface, each said leg assembly including a top leg fixed to and projecting downwardly from the top and being vertically slidable supported on a lower leg for permitting adjustment in the height of the top, and a powered drive arrangement mounted on the table and drivingly coupled to said pair of leg assemblies for permitting powered vertical displacement of said top legs to adjust the height of said top, comprising the improvement wherein:

said drive arrangement includes a pair of powered drive means each associated with a respective one of said leg assemblies for effecting powered vertical displacement of the top leg of the respective leg assembly, each said drive means including a low-voltage direct current electric motor and a rotary-to-linear motion converter means for effecting vertical extension and contraction of a respective said leg assembly, the rotary-to-linear motion converter means including a rotary input member which is drivingly coupled to the respective electric motor and a linearly-movable output member which is coupled to one of the legs of the respective leg assembly, the rotary-to-linear motion converter associated with each said leg assembly being free of mechanical driving connection with the motion converter of the other said leg assembly, said pair of powered drive means being operatively coupled together solely by electrical cable means for transmitting electrical energy between said motors; and controller means operatively coupled with the pair of drive means for simultaneously controlling the rotation of the motors of said pair of drive means for synchronizing the extension and contraction of said pair of leg assemblies, said controller means includes means for sensing when one said motor is rotating faster than the other said motor and for slowing the rotation of the faster-running motor so that it substantially equals the rotation of the slower-running motor.

2. A table according to claim 1, including portable pendant-type keypad control means removably positioned on said top for activating said controller means.

3. A table, particularly adapted for supporting a computer, comprising:

a base adapted for deposition on a support surface such as a floor, said base having a pair of horizontally-spaced upright pedestals;

a front top assembly including a horizontally enlarged worksurface-defining front top having a pair of sidewardly spaced and generally parallel elongate legs fixed to said top and projecting downwardly therefrom in cantilevered relationship, each of said legs being vertically slidably supported on a respective one of said pedestals;

a rear top assembly including a horizontally enlarged worksurface-defining rear top having a pair of sidewardly spaced and generally parallel elongate legs fixed to said top and projecting downwardly therefrom in cantilevered relationship, each of said legs being vertically slidably supported on a respective one of said pedestals;

a powered drive arrangement including front and rear lifting means respectively coacting with sad front and rear top assemblies for effecting vertical movement thereof to adjust the height of the respective front and rear tops;

controller means operatively coupled to said powered drive arrangement for controlling activation of said front and rear lifting means including programming means for permitting storage of predetermined height locations each representing front and rear height values corresponding to predetermined heights of the respective front and rear tops, and means for automatically activating said front and rear lifting means to respectively move said front and rear tops to heights defined by a preselected said height location;

said controller means including timing means for defining a predetermined time interval corresponding to said preselected height location for maintaining said front and rear tops at said heights for said time interval; and operator-activated control means for permitting operator selection of said preselected height location and initiation of said activating means.

4. A table according to claim 3, wherein said controller means includes sequencing means for defining a series of table events wherein each said table event defines a distinct stored predetermined height location and a distinct defined time interval, and said activating means including means for causing automatic activation of said series of table events only upon receipt of a signal from said operator-activated control means so as to permit activation of the next event.

5. In an adjustable work station defining separately movable front and rear height-adjustable support surfaces which are respectively adapted to support thereon a keyboard and an associated information display screen, and drive means cooperable with said support surfaces for adjusting them to a desired relative height arrangement wherein said front support surface is disposed at a first height and said rear support surface is disposed at a second height, said first and second heights defining a height value pair, the improvement comprising:

height determination means for determining first and second height values which respectively correspond to the first and second heights at which said front and rear support surfaces are currently disposed;

storage means for uniquely identifying and storing a plurality of said height value paris which correspond to various possible relative height arrangements of said front and rear support surfaces;

display means operatively coupled to said storage means and responsive to a predetermined user input for retrieving a selected one of said height value pairs from said storage means and producing a visual display of said selected height value pair; and adjustment means operatively coupled to said drive means and responsive to a predetermined user input for automatically adjusting said front and rear support surfaces to a relative height arrangement wherein said support surfaces are disposed at the respective heights represented by the corresponding height values of the selected height value pair.

6. A work station according to claim 5, wherein said adjustment means, in response to said predetermined user input, includes means for first vertically moving said rear support surface to the height corresponding to the rear height value of the selected height value pair, and for then automatically thereafter moving the front rear surface to the height corresponding to the front height value of the selected height value pair.

7. A work station according to claim 6, wherein said drive means includes rotatable electric motor means for driving rotatable output members, and said height determination means includes means for sensing and counting the rotations of said rotatable output members so as to determine said height values.

8. A work station according to claim 6, wherein said adjustment means includes means for admitting a visual and/or audible warning after receipt of said predetermined user input but prior to initiation of the movement of rear support surface, and said means also emitting a visual and/or audible warning after said rear support surface has reached its respective height but prior to initiating the movement of the front support surface.

9. A work station according to claim 5, including:

timer means for measuring elapsed time and indicating that a predetermined amount of time has elapsed;

sequencing means for storing a defined sequence of work station events with each event being defined by one of the previously stored height value pairs in combination with a selected time interval; and said adjustment means including means for automatically adjusting said front and rear support surfaces sequentially according to the height values and time intervals defined by the sequential events stored in the sequencing means in response to a predetermined user input prior to initiation of each said event.

10. A work station according to claim 9, wherein said adjustment means includes means for emitting a visual and/or audible warning after receipt of said predetermined user input but prior to initiation of the movement of the rear support surface, and said means also emitting a visual and/or audible warning after said rear support surface has reached its respective height but prior to initiating the movement of the front support surface.

11. A work station according to claim 5, including right and left telescopically extendible and contractible leg assemblies connected to and projecting downwardly from each of said support surfaces, said drive means including separate right and left drives respectively associated with each of said right and left leg assemblies for controlling vertical extension and contraction thereof to adjust the height of the respective support surface, each said right and left drive respectively including right and left electric motors, and control means for causing synchronous rotation of the right and left motors associated with the respective support surface and for automatically adjusting one of said motors relative to the other to substantially equalize vertical displacement of the right and left leg assemblies of the respective support surface.

12. A work station according to claim 11, wherein the drive means includes a rotatable output member associated with each said support surface, the height determination means including means for sensing and counting the rotations of the rotatable output members so as to determine the height values, and the control means includes means for sensing when one of the right and left motors is rotating faster than the other of said right and left motors and for adjusting the speed of at least one of the motors so as to substantially equalize the rotation of the right and left motors.

13. A table, particularly adapted for supporting a computer, comprising:

a base adapted for deposition on a support surface such as a floor, said base having a pair of horizontally-spaced upright pedestals;

a front top assembly including a horizontally enlarged worksurface-defining front top having a pair of sidewardly spaced and generally parallel elongate legs fixed to said top and projecting downwardly therefrom in cantilevered relationship, each of said legs being vertically slidably supported on a respective one of said pedestals;

a rear top assembly including a horizontally enlarged worksurface-defining rear top having a pair of sidewardly spaced and generally parallel elongate legs fixed to said top and projecting downwardly therefrom in cantilevered relationship, each of said legs being vertically slidably supported on a respective one of said pedestals;

a powered drive arrangement including front and rear lifting means respectively coacting with said front and rear top assemblies for effecting vertical movement thereof to adjust the height of the respective front and rear tops;

said lifting means as respectively associated with each said top assembly including a pair of powered drive means each associated with a respective one of the legs, each said drive means including a low-voltage direct current electric motor drivingly coupled to a rotary input of a rotary-to-linear motion converter means having a linearly-movable output coupled to the respective leg for effecting vertical raising and lowering of the leg;

controller means operatively coupled to said powered drive arrangement for controlling activation of said front and rear lifting means including programming means for permitting storage of predetermined height locations each representing front and rear height values corresponding to predetermined heights of the respective front and rear tops, and activating means for automatically activating said front and rear lifting means to respectively move said front and rear tops to heights defined by a preselected said height location;

said controller means also including means for simultaneously controlling the rotation of the motors of said pair of drive means associated with one of said top assemblies for synchronizing the vertical raising and lowering of the pair of legs; and operator-activated control means for permitting operator selection of said preselected height location and initiation of said activating means.

14. A table according to claim 13, wherein said controller means includes means for sensing when one said motor of said pair of drive means is rotating faster than the other said motor and for slowing the rotation of the faster-running motor so that it substantially equals the rotation of the slower-running motor.

15. A table according to claim 14, wherein each said controller means includes means for sensing and counting the rotation of rotatable output members associated with the pair of motors so as to determine a height value for the top assembly, and display means for visually displaying the height of the top assembly.

16. A table, particularly adapted for supporting a computer, comprising:

a base adapted for deposition on a support surface such as a floor, said base having a pair of horizontally-spaced upright pedestals;

a front top assembly including a horizontally enlarged worksurface-defining front top having a pair of sidewardly spaced and generally parallel elongate legs fixed to said top and projecting downwardly therefrom in cantilevered relationship, each of said legs being vertically slidably supported on a respective one of said pedestals;

a rear top assembly including a horizontally enlarged worksurface-defining rear top having a pair of sidewardly spaced and generally parallel elongate legs fixed to said top and projecting downwardly therefrom in cantilevered relationship, each of said legs being vertically slidably supported on a respective one of said pedestals;

a powered drive arrangement including front and rear lifting means respectively coacting with said front and rear top assemblies for effecting vertical movement thereof to adjust the height of the respective front and rear tops;

controller means operatively coupled to said powered drive arrangement for controlling activation of said front and rear lifting means including programming means for permitting storage of predetermined height locations each representing front and rear height values corresponding to predetermined heights of the respective front and rear tops, and activating means for automatically activating said front and rear lifting means to respectively move said front and rear tops to heights defined by a preselected said height location, said activating means including means sequentially activating first said rear top and then said front top; and operator-activated control means for permitting operator selection of said preselected height location and initiation of said activating means.

* * * * *

UNITED STATES PATENT AND TRADEMARK OFFICE

CERTIFICATE OF CORRECTION

PATENT NO. : 5,259,326

DATED : November 9, 1993

INVENTOR(S) : Randall W. BORGMAN et al

It is certified that error appears in the above-identified patent and that said Letters Patent is hereby corrected as shown below:

Column 16, line 56; change "slidable" to ---slidably---.

Column 17, line 49; change "sad" to ---said---.

Column 18, line 30; change "paris" to ---pairs---.

Signed and Sealed this

Twenty-fourth Day of May, 1994

Bruce Lehman

*Attest:*

BRUCE LEHMAN

*Attesting Officer*

*Commissioner of Patents and Trademarks*